United States Patent [19]

Fischer

[11] Patent Number: 4,913,434

[45] Date of Patent: Apr. 3, 1990

[54] FRAME FOR A BALL GAME RACQUET

[75] Inventor: Josef Fischer, Ried im Innkreis, Austria

[73] Assignee: Fischer Gesellschaft m.b.H., Ried im Innkreis, Austria

[21] Appl. No.: 189,843

[22] Filed: May 3, 1988

[30] Foreign Application Priority Data

May 5, 1987 [AT] Austria ..... 1122/87

[51] Int. Cl.[4] ..... A63B 49/14

[52] U.S. Cl. ..... 273/73 C; 273/73 D

[58] Field of Search ..... 273/73 R, 73 C, 73 D, 273/73 F, 73 H, 73 K

[56] References Cited

U.S. PATENT DOCUMENTS

| | | | |
|---|---|---|---|
| 1,930,285 | 10/1933 | Robinson | 273/73 D |
| 3,545,756 | 12/1970 | Nash | 273/73 C X |
| 3,814,423 | 6/1974 | Shockley et al. | 273/73 C |
| 4,194,738 | 3/1980 | Inoue et al. . | |
| 4,204,681 | 5/1980 | Hall, Jr. et al. | 273/73 C |
| 4,278,251 | 7/1981 | Lafourcade | 273/73 C |
| 4,314,699 | 2/1982 | Bayer et al. | 273/73 D |
| 4,436,305 | 3/1984 | Fernandez | 273/73 D |
| 4,496,152 | 1/1985 | Mott | 273/73 C |
| 4,776,592 | 10/1988 | Umlauft et al. | 273/73 D |

FOREIGN PATENT DOCUMENTS

| | | | |
|---|---|---|---|
| 0219310 | 4/1987 | European Pat. Off. | 273/73 D |
| 2042803 | 3/1971 | Fed. Rep. of Germany . | |
| 2235791 | 1/1974 | Fed. Rep. of Germany . | |
| 2187392 | 7/1987 | United Kingdom | 273/73 D |

*Primary Examiner*—Edward M. Coven
*Assistant Examiner*—William E. Stoll
*Attorney, Agent, or Firm*—Fleit, Jacobson, Cohn, Price, Holman & Stern

[57] ABSTRACT

In a frame (1') for ball game racquets made of plastic the abrasion and cutting of the guts against the edges of passages in the frame is avoided. For that purpose the frame (1') comprises a center strip (3) of thermoplastic resin, the hardness of which is less than or equal to the hardness of the guts. Hollow profiles (4, 5) of duroplastic, fiber-reinforced synthetic resin are molded onto both sides of the center strip. The passages are drilled into the center strip (3) after the frame has been produced and then the frame is strung.

4 Claims, 1 Drawing Sheet

FIG. 1
(PRIOR ART)
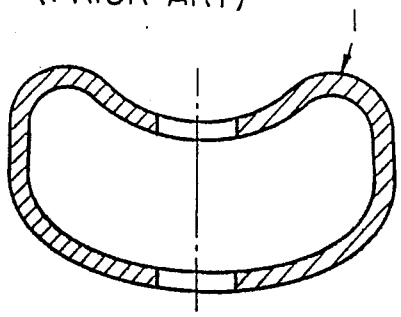
FIG. 2
(PRIOR ART)
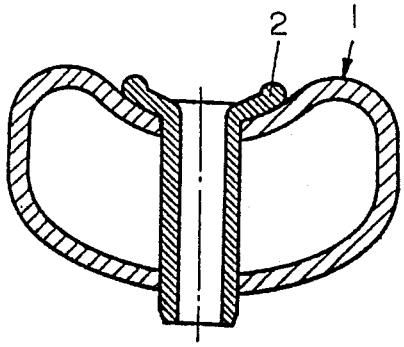
FIG. 3
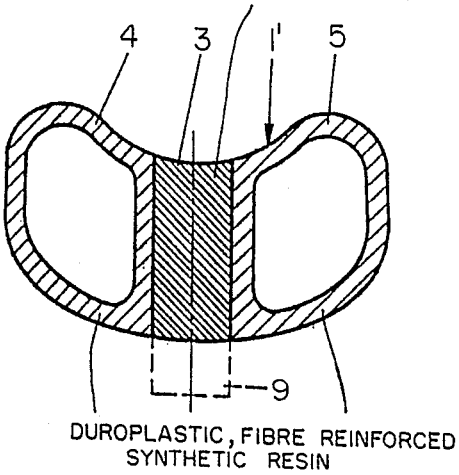
FIG. 4
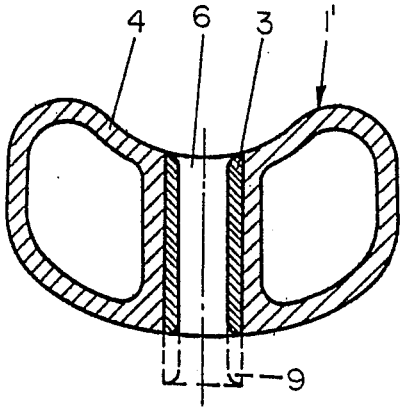
FIG. 5
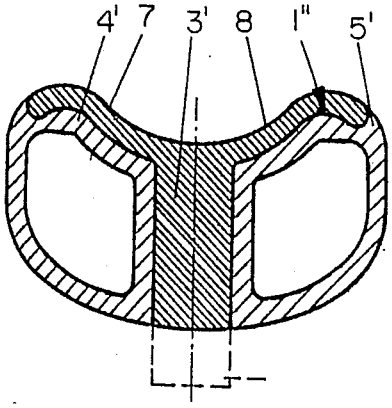
FIG. 6
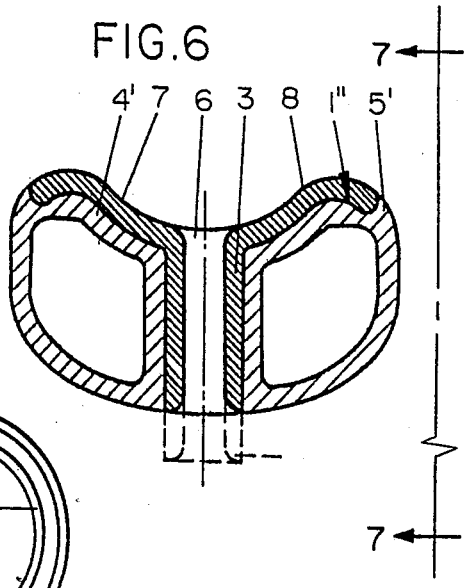
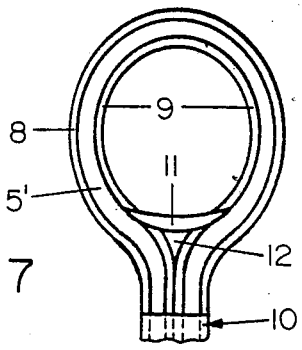
FIG. 7

FRAME FOR A BALL GAME RACQUET

BACKGROUND OF THE INVENTION AND PRIOR ART

The invention relates to a frame for a ball game racquet, in particular tennis or squash racquet comprising two hollow profiles and a member held therebetween in which passages are provided through which the guts are to be strung.

It is known to manufacture ball game racquets from a combination of bundles of synthetic fibres together with resins, usually duraplastics based on epoxy resins. The fibres can be embedded in the plastics in the form of fabrics, non-woven sheets or in unidirectional orientation (prepregs), the plastics being present in a so-called B conditions. These prepregs are then further processed to form the desired product in presses or autoclaves, whereby heat and pressure are supplied.

FIG. 1 illustrates a frame profile 1 manufactured in that manner and after a passage has been drilled therethrough. However, that frame 1 cannot be strung without an adaptation of the passages by means of individual eyelets or strips of eyelets 2, being made of soft thermoplastic resins according to FIG. 2, since otherwise the guts would be cut or ripped apart along the edges of the frame 1 bordering the passage.

However, the manufacture and fitting of the individual eyelets or eyelet strips 2 is expensive. In particular the use of eyelet strips presupposes the provision of numerous different eyelet strips adapted to the particular types of racquets, for the manufacture of each eyelet strip a special tool being require.

From U.S. Pat. No. 4,436,307 a tennis racquet has become known, the frame of which is composed of an integral profile in one piece and two hollow profiles interconnected by a central web, the space between the two hollow profiles and the central web being filled by a plastic ribbon connected to the opposite plastic ribbon by webs passing through apertures in the central web. The manufacture of such a frame profile is elaborate and requires the use of inserts. Moreover, apertures have to be drilled through the web interconnecting the two hollow profiles in order to provide the means for connecting the two inserted plastics ribbons. Moreover, the plastic member interconnecting the two hollow profiles must similarly be drilled in order to provide the holes for introducing the guts. Accordingly, two drilling procedures are necessary involving a high degree of manufacturing effort.

GENERAL DESCRIPTION OF INVENTION AND OBJECTS

An object of the invention is the provision of a novel racquet frame without eyelets which avoids the aforesaid disadvantages and protects the strings against being cut, the frame being ready to be strung immediately, respectively, after the provision of the passages.

Further or alternative objects will become apparent from what follows.

According to the invention a frame is provided as set out in the opening paragraph, wherein the intermediate member takes the form of a central strip which is solid and which is connected on both sides, each side to one of the hollow profiles being made of duroplastic fibre-reinforced synthetic resin, the central strip being composed optionally of a thermoplastic, a duraplastic, an elastomer, in each case optionally with fibre-reinforcement, caoutchouc, ceramics, wood, metal, e.g. non-ferrous metal, light metal or alloys thereof or a composite of one or more of the aforesaid materials.

According to a specific detail of the invention, provision is made for the central strip to extend from the inward side to at least the outward side of the frame.

In accordance with a further specific feature of the invention, the central strip comprises extensions on both sides of the frame outside, extending to the periphery of the hollow profiles and merging therewith in an integrated manner.

A further feature of the invention provides that the central strip comprises a projection along the frame inside, opposite to the hollow profiles.

BRIEF DESCRIPTION OF THE DRAWINGS

Further features and details of the invention will be explained in the following with reference to the drawing.

FIG. 1 represents a frame of known type in cross section,

FIG. 2 represents an adapted frame according to FIG. 1 in cross section, FIG. 3 represents a first frame according to the invention in cross section, FIG. 4 represents the first frame, including a passage drilled therethrough, FIG. 5 represents a second frame according to the invention, FIG. 6 the second frame with a passage drilled therethrough , and FIG. 7 represents a schematic elevational view of the second frame as viewed in the direction of the arrows 7-7 in FIG. 6.

DESCRIPTION OF SPECIFIC EMBODIMENTS

According to the first working example of FIGS. 3 and 4, a central strip 3, e.g. of thermoplastic is provided having moulded thereto hollow profiles 4, 5 of duraplastic, fibre-reinforced plastic on both sides. The hollow profiles, 4, 5 are of a pothandle-shaped configuration and are arranged symmetrically about the centre line of the centre strip, which coincides with the neutral zone of the frame 1' and with the centre line of the bored passage 6. As can be seen from FIG. 4, the edges of the bored passage 6 are rounded off. The bored passages 6 can be produced, e.g. by drilling, either before or after the production of the frame.

The manufacture of the frame proceeds in such a manner that the two premoulded hollow profiles which have not yet been fully cured are inserted jointly with the premoulded centre strip into an appropriate mould, whereafter, with the action of heat and pressure and with simultaneously subjecting the ends of the hollow profiles which project from the mould in sealing relationship to compressed air, a remoulding, bonding and curing takes place. In order to assure a good bond, the surfaces of the three components may be roughened at their bounding localities by grinding, etching or the like.

In the second embodiment according to FIGS. 5 and 6, the centre strip 3' of the frame 1'' comprises extensions in both directions on the frame outside, extending up to the rim of the hollow profiles 4'', 5'' and merging therewith in an integrated manner. The lateral extensions 7, 8 provide protection against wear to prevent damage to the racquet when touching the ground.

In those embodiments according to FIGS. 3, 4 and 5, 6, the central strip 3, 3' may comprise on the frame inside and between the hollow profiles 4, 5, and 4', 5', respectively, a projection 9 whereby damping properties of the frame 1' or 1'' are improved.

As is illustrated in FIG. 7, the centre strip 3, 3' may extend around the frame 1', 1'' and right into the handle 10 of the frame and beyond the web or bridge portion 11 of the heart member 12. The width of the central strip 3, 3' is so selected that a material wall thickness of the central strip of 0.1 to 3 mm, preferably 0.5 to 1 mm, is left standing on either side of the passages. The hardness value of the material of the centre strip 3, 3' is preferably so selected that it is equal to or less than the hardness of a gut for the stringing of the racquet.

The above description of the drawings should be read in combination with and as a mere illustration of the more general preceding description of the invention.

The claims which follow are to be considered an integral part of the present disclosure.

What we claim is:

1. A frame for a ball game racquet, in particular a tennis or squash racquet, comprising a solid central strip extending at least along a circumference of a racquet hitting area and having passages therein through which guts of the racquet are to be strung to define a plane of the hitting area, and two hollow profiles, made of duroplastic, fibre reinforced synthetic resin, which are not connected to each other in the area of the central strip but are connected to opposite sides of the central strip with respect to the plane of the hitting area defined by the guts when the guts are strung through the passages in the central strip, the passages through which the guts are strung being provided solely in the central strip, the central strip being made from a synthetic resin having a hardness value smaller than that of the guts, the central strip extending from an inward side to at least an outward side of the frame, and the central strip comprising lateral extensions on outer peripheral portions of the frame, the extensions extending laterally in opposite directions adjacent to respective outer rims of the hollow profiles and merging therewith in an integrated manner.

2. A frame for a ball game racquet, in particular a tennis or squash racquet, comprising a solid central strip extending at least along a circumference of a racquet hitting area and having passages therein through which guts of the racquet are to be strung to define a plane of the hitting area, and two hollow profiles, made of duroplastic, fibre reinforced synthetic resin, which are not connected to each other in the area of the central strp but are connected to opposite sides of the central strip with respect to the plane of the hitting area defined by the guts when the guts are strung through the passages in the central strip, the passages through which the guts are strung being provided solely in the central strip, the central strip being made from a synthetic resin having a hardness value smaller than that of the guts, the central strip extending from an inward side to at least an outward side of the frame, and the central strip comprising a projection extending along an inner periphery of the frame between the hollow profiles.

3. A frame for a ball game racquet, in particular a tennis or squash racquet, comprising a solid central strip extending at least along a circumference of a racquet hitting area and having passages therein through which guts of the racquet are to be strung to define a plane of the hitting area, and two hollow profiles, made of duroplastic, fibre reinforced synthetic resin, which are not connected to each other in the area of the central strip but are connected to opposite sides of the central strip with respect to the plane of the hitting area defined by the guts when the guts are strung through the passages in the central strip, the passages through which the guts are strung being provided solely in the central strip, the central strip being made from a synthetic resin having a hardness value smaller than that of the guts, the central strip extending around the frame and into a handle of the frame and beyond a web of a heart member, and the central strip comprising a projection extending along an inner periphery of the frame between the hollow profiles.

4. A frame for a ball game racquet, in particular a tennis or squash racquet, comprising a solid central strip extending at least along a circumference of a racquet hitting area and having passages therein through which guts of the racquet are to be strung to define a plane of the hitting area, and two hollow profiles, made of duroplastic, fibre reinforced synthetic resin, which are not connected to each other in the area of the central strip but are connected to opposite sides of the central strip with respect to the plane of the hitting area defined by the guts when the guts are strung through the passages in the central strip, the passages through which the guts are strung being provided solely in the central strip, the central strip being made from a synthetic resin having a hardness value smaller than that of the guts, opposite sides of each of the passages for the guts, adjacent respective ones of the profiles, having a material wall thickness of 0.1 to 3 mm, and the central strip comprising lateral extensions on outer peripheral portions of the frame, the extensions extending laterally in opposite directions adjacent to respective outer rims of the hollow profiles and merging therewith in an integrated manner.

* * * * *